US010556649B2

(12) United States Patent
Forrest

(10) Patent No.: US 10,556,649 B2
(45) Date of Patent: Feb. 11, 2020

(54) WAKE ENHANCEMENT APPARATUS AND METHOD

(71) Applicant: Kris Douglas Forrest, San Martin, CA (US)

(72) Inventor: Kris Douglas Forrest, San Martin, CA (US)

(73) Assignee: Steven Clothier, South Lake Tahoe, CA (US)

( * ) Notice: Subject to any disclaimer, the term of this patent is extended or adjusted under 35 U.S.C. 154(b) by 0 days.

(21) Appl. No.: 15/938,931

(22) Filed: Mar. 28, 2018

(65) Prior Publication Data

US 2018/0281906 A1 Oct. 4, 2018

Related U.S. Application Data

(60) Provisional application No. 62/478,995, filed on Mar. 30, 2017.

(51) Int. Cl.

| | |
|---|---|
| ***B63B 35/85*** | (2006.01) |
| ***B63B 17/00*** | (2006.01) |
| *B63B 1/28* | (2006.01) |

(52) U.S. Cl.

CPC ..... *B63B 35/85* (2013.01); *B63B 17/00* (2013.01); *B63B 1/28* (2013.01); *B63B 2035/855* (2013.01)

(58) Field of Classification Search

CPC ..... B63B 2035/855; B63B 1/28

See application file for complete search history.

(56) References Cited

U.S. PATENT DOCUMENTS

| | | | | |
|---|---|---|---|---|
| 5,664,910 | A * | 9/1997 | Lochtefeld | A63B 69/0093 114/253 |
| 5,860,384 | A | 1/1999 | Castillo | |
| 7,140,318 | B1 * | 11/2006 | Gasper | B63B 1/18 114/282 |
| 8,539,897 | B1 | 9/2013 | Gasper | |
| 9,422,028 | B2 | 8/2016 | Wilhelm | |
| 9,669,903 | B2 | 6/2017 | Gasper | |
| 9,802,684 | B2 | 10/2017 | Sheedy | |
| 9,855,995 | B2 | 1/2018 | Fafard | |
| 9,988,126 | B2 * | 6/2018 | Wood | B63B 1/22 |
| 2016/0009342 | A1 | 1/2016 | Thomas | |
| 2017/0320552 | A1 * | 11/2017 | Taylor | B63B 35/85 |

* cited by examiner

*Primary Examiner* — Andrew Polay

(74) *Attorney, Agent, or Firm* — Ellenoff Grossman & Schole LLP; James M. Smedley; Alex Korona

(57) ABSTRACT

A wake enhancement apparatus is disclosed. The wake enhancement apparatus has a receiver assembly that is watercraft-attachable, an attachment assembly that is removably attachable to the receiver assembly, a connecting assembly having a first end portion attached to the attachment assembly, the connecting assembly extending downward from the attachment assembly, and a lower assembly attached to a second end portion of the connecting assembly. The lower assembly has a first portion extending from the connecting assembly and a second portion extending from the first portion. The first portion is bent downward and the second portion is bent upward.

15 Claims, 11 Drawing Sheets

WAKE ENHANCEMENT APPARATUS AND METHOD

RELATED APPLICATIONS

This application claims the benefit of U.S. Provisional Patent Application Ser. No. 62/478,995 filed Mar. 30, 2017, which is hereby incorporated by reference in its entirety.

TECHNICAL FIELD

The present disclosure is directed to an apparatus and method for wake enhancement, and more particularly, to an apparatus and method for wake enhancement for a watercraft.

BACKGROUND OF THE DISCLOSURE

Wake enhancement devices are popular accessories in the recreational boating industry, and are used for example to provide waves for surfing. Conventional wake boats, though, are typically expensive and not a practical alternative for many consumers.

As an alternative to dedicated wake boats, significant amounts of ballast may be added to a boat to produce enhanced wakes. However, such conventional techniques typically result in the loss of storage room on watercraft, as well as a degradation in boat handling (e.g., sluggish boat handling). For example, storage space is lost due to equipment such as tanks, which may take an excessive amount of time to fill and drain. Also, conventional wake enhancement devices may involve excessive time and cost for pump and hose maintenance. Further, conventional wake enhancement devices typically do not provide shaped wakes that surfers and other consumers can ride for suitable periods of time.

Other conventional wake enhancement devices include trim tabs and wake delays. However, trim tabs are typically expensive and difficult to install, while being marginally effective and typically unable to provide down force to a watercraft. Similarly, wake delays are also typically marginally effective and provide little or no down force to a watercraft.

The exemplary disclosed apparatus and method of the present disclosure is directed to overcoming one or more of the shortcomings set forth above and/or other deficiencies in existing technology.

SUMMARY OF THE DISCLOSURE

In one exemplary aspect, the present disclosure is directed to a wake enhancement apparatus. The wake enhancement apparatus includes a receiver assembly that is watercraft-attachable, an attachment assembly that is removably attachable to the receiver assembly, a connecting assembly having a first end portion attached to the attachment assembly, the connecting assembly extending downward from the attachment assembly, and a lower assembly attached to a second end portion of the connecting assembly. The lower assembly has a first portion extending from the connecting assembly and a second portion extending from the first portion. The first portion is bent downward and the second portion is bent upward.

In another aspect, the present disclosure is directed to a wake enhancement method. The wake enhancement method includes attaching a receiver assembly to a watercraft, removably attaching a reverse hydrofoil to the receiver assembly, and controlling wake characteristics of the watercraft based on positioning the reverse hydrofoil. The reverse hydrofoil is in a position that is angled upward or downward relative to a horizontal plane when the reverse hydrofoil is attached to the receiver assembly.

BRIEF DESCRIPTION OF THE DRAWINGS

Accompanying this written specification is a collection of drawings of exemplary embodiments of the present disclosure. One of ordinary skill in the art would appreciate that these are merely exemplary embodiments, and additional and alternative embodiments may exist and still within the spirit of the disclosure as described herein.

DETAILED DESCRIPTION AND INDUSTRIAL APPLICABILITY

The exemplary apparatus and method may be a suitable apparatus and method for wake enhancement. For example, the exemplary apparatus and method may be used with any suitable type of watercraft, e.g., for enhancing a wake of a watercraft.

Figure 1:
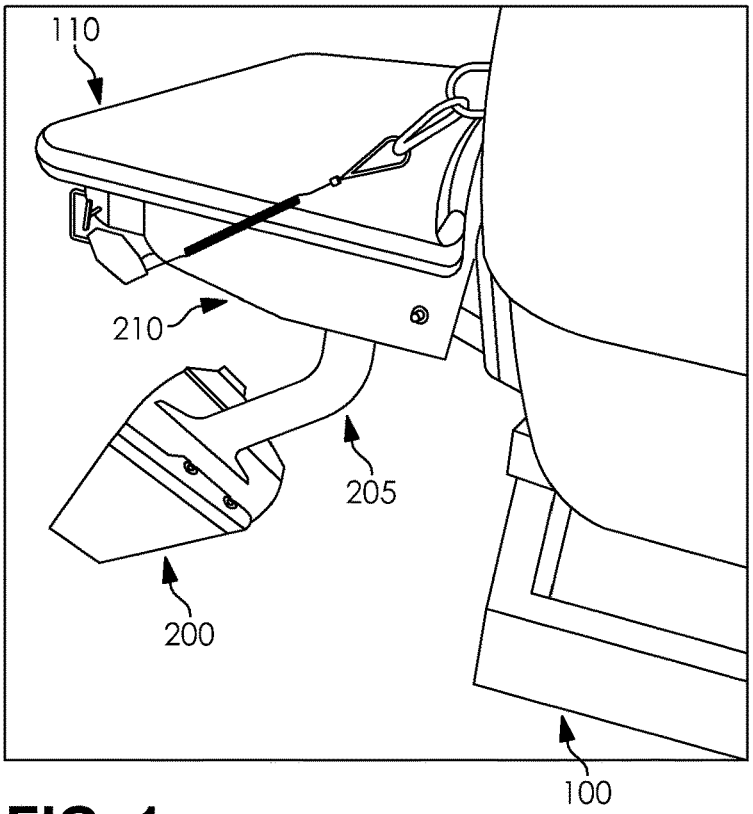
FIG. 1 is a perspective illustration of an exemplary apparatus, in accordance with at least some exemplary embodiments of the present disclosure.

FIGS. 1 illustrates an assembly 200 that may be an exemplary apparatus for wake enhancement. Assembly 200 may be mounted or attached to a watercraft 100. Watercraft 100 may be any suitable type of watercraft for mounting of assembly 200 such as, for example, a propeller-driven boat, a jetboat, or a jet ski. For example, an attachment of assembly 200 to watercraft 100 may involve no hull modifications to watercraft 100.

Assembly 200 may be, for example, a down force device for a watercraft, a wake control device for a watercraft, and/or a wake shaping device for a watercraft. Assembly 200 may include a foil assembly 205 and a receiver assembly 210. Receiver assembly 210 may be attachable to a portion of watercraft 100 as disclosed for example herein. Foil assembly 205 may be removably attachable to (e.g., removably received by) receiver assembly 210.

Assembly 200 may be formed from any suitable materials for providing a wake enhancement device such as, for example, metallic, plastic, and/or hybrid materials. For example, some or substantially all portions of assembly 200 may include steel, aluminum, carbon fiber, and/or any other structural material having suitable properties for use in hydromechanical applications. Also for example, some or substantially all portions of assembly 200 may include polymer material, structural metal (e.g., structural steel or structural aluminum), co-polymer material, thermoplastic and thermosetting polymers, resin-containing material, polyethylene, polystyrene, polypropylene, epoxy resins, phenolic resins, Acrylanitrile Butadiene Styrene (ABS), Polycarbonate (PC), Mix of ABS and PC, Acetal (POM), Acetate, Acrylic (PMMA), Liquid Crystal Polymer (LCP), Mylar, Polyamid-Nylon, Polyamid-Nylon 6, Polyamid-Nylon 11, Polybutylene Terephthalate (PBT), Polycarbonate (PC), Polyetherimide (PEI), Polyethylene (PE), Low Density PE (LDPE), High Density PE (HDPE), Ultra High Molecular Weight PE (UHMW PE), Polyethylene Terephthalate (PET), PolPolypropylene (PP), Polyphthalamide (PPA), Polyphenylenesulfide (PPS), Polystyrene (PS), High Impact Polystyrene (HIPS), Polysulfone (PSU), Polyurethane (PU), Polyvinyl Chloride (PVC), Chlorinated Polyvinyl chloride (CPVC), Polyvinylidenefluoride (PVDF), Styrene Acrylonitrile (SAN), Teflon TFE, Thermoplastic Elastomer (TPE), Thermoplastic Polyurethane (TPU), and/or Engineered Thermoplastic Polyurethane (ETPU), or any suitable combination thereof.

Figure 2:
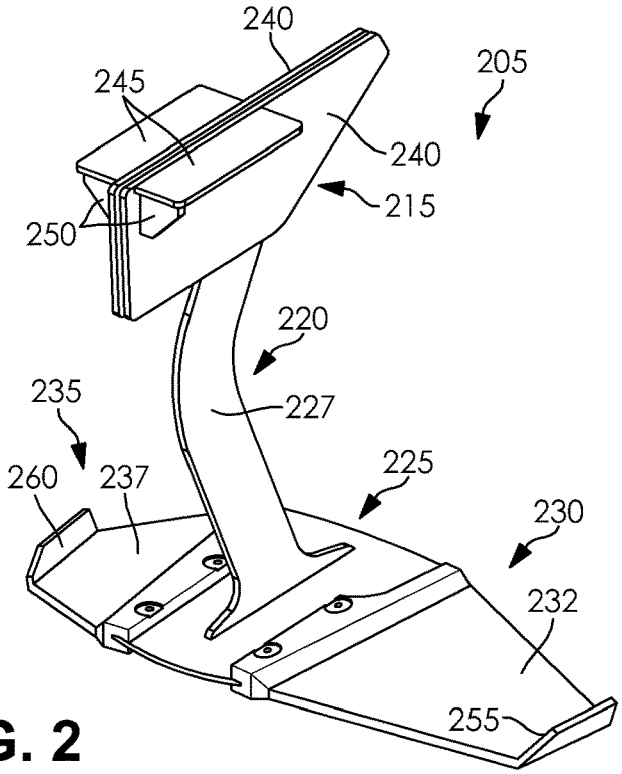
FIG. 2 is a perspective illustration of an exemplary apparatus, in accordance with at least some exemplary embodiments of the present disclosure.
Figure 3:
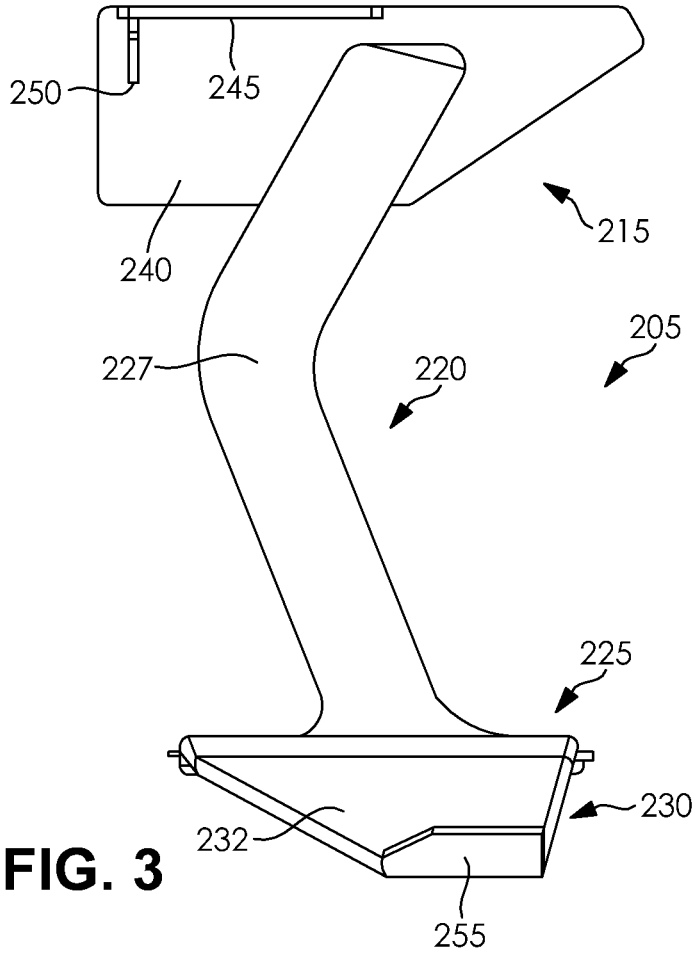
FIG. 3 is a side view of an exemplary apparatus, in accordance with at least some exemplary embodiments of the present disclosure.

As illustrated in FIGS. 2 and 3, foil assembly 205 may include an attachment assembly (e.g., assembly 215) that may attach foil assembly 205 to receiver assembly 210, a connecting member (e.g., member 220) that may attach a member 225 to assembly 215, and members 230 and 235 that may be attached to member 225. Members 230 and 235 may be, for example, wing foils that may be attached to member 225. Portions of assembly 215, member 220, member 225, member 230, and member 235 may be attached by any suitable technique (e.g., welding and/or mechanical fasteners) and/or may be integrally formed.

In at least some exemplary embodiments, assembly 215 may include for example a plurality of members 240, 245, and 250 configured to removably attach foil assembly 205 to receiver assembly 210 and/or attach foil assembly 205 directly to a portion of watercraft 100 (e.g., a swim board or other portion of watercraft 100). For example as illustrated in FIGS. 2 and 3, assembly 215 may include vertical members 240 that may be attached to both sides of member 220. Members 245 may be attached at a substantially perpendicular or normal plane to members 240 at an upper portion of members 240. Members 250 may for example serve as brackets to help to support the attachment of each member 245 to each member 240. Members 240, 245, and 250 may be, e.g., received by receiver assembly 210 as disclosed for example below and/or be directly attached to a portion of watercraft 100. Assembly 215 may include any suitable configuration for removably attaching foil assembly 205 to receiver assembly 210 and/or directly attaching foil assembly 205 to watercraft 100. Assembly 215 may also, for example, include a single member configured to removably attach foil assembly 205 to receiver assembly 210 and/or directly attach foil assembly 205 to watercraft 100.

Member 220 may be an elongated substantially vertical member such as a pylon member or a strut member that may attach assembly 215 to member 225. Member 220 may be an angled member having a bent portion 227. For example, bent portion 227 may be angled at any suitable configuration such as, for example, up to about 30 degrees, up to about 20 degrees, up to about 10 degrees, or up to between about 1 and about 5 degrees. For example, member 220 may be angled based on desired hydromechanical properties and design of foil assembly 205 and desired wake (e.g., wave) characteristics to be created by assembly 200. Also for example, member 220 may be a substantially straight member that is attached at an angle to assembly 215.

Members 230 and 235 may be attached to member 225 (e.g., by fasteners, welding, and/or any other suitable technique) or may be integrally formed with member 225. Members 230 and 235 may for example be symmetrically shaped to each other relative to a vertical plane (e.g., a vertical plane of member 220). Members 230 and 235 may also for example have different configurations based on desired hydromechanical properties and design of assembly 205 and desired wake (e.g., wave) characteristics to be created by assembly 200. Members 230 and 235 may for example include respective portions 232 and 237 that may be downwardly-extending portions that extend downwardly (e.g., at an angle such as, for example, a downward angle from a horizontal plane) from member 225. Members 230 and 235 may also include, for example, respective upward-extending tip portions 255 and 260 (e.g., that respectively extend upwardly from downwardly-extending portions 232 and 237). For example, portions 255 and 260 may be bent upwards and extend upwards relative to respective portions 232 and 237. For example, portions 232 and 255 of member 230 and/or portions 237 and 260 of member 235 may form a reverse foil or reverse hydrofoil (e.g., an inverse foil or inverse hydrofoil such as a wing foil or a dagger foil). For example during the operation of foil assembly 205 as a hydrofoil (e.g., reverse hydrofoil) attached to watercraft 100, upwardly-extending tip portions 255 and 260 may cause a down force to be developed and applied to assembly 200, which may also be applied to watercraft 100. Foil assembly 205, including portions 232, 237, 255, and/or 260, may be configured in any desired configuration (e.g., symmetrically or asymmetrically relative to a plane of member 220) to develop a desired down force to be applied to watercraft 100 (e.g., and/or create a lift force). Also for example, foil assembly 205, including portions 232, 237, 255, and/or 260, may be configured in any desired configuration based on desired wake (e.g., wave) characteristics to be created by assembly 200. For example based on downwardly-extending portions 232 and 237 and upwardly-extending tip portions 255 and 260, foil assembly 205 may be a reverse hydrofoil (e.g., an inverse hydrofoil) that applies a downward force to watercraft 100. For example, foil assembly 205, including portions 232, 237, 255, and/or 260, may develop any desired amount of down force to be applied to watercraft 100 such as, for example, up to about 1,500 pounds of down force or up to about 1,000 pounds of down force. For example, foil assembly 205, including portions 232, 237, 255, and/or 260, may develop up to about 900 pounds of down force on watercraft 100. Any desired greater or smaller amount of down force may also be developed based on a configuration of foil assembly 205, including portions 232, 237, 255, and/or 260, based on for example a size, displacement, and/or type of watercraft 100.

Figure 4:
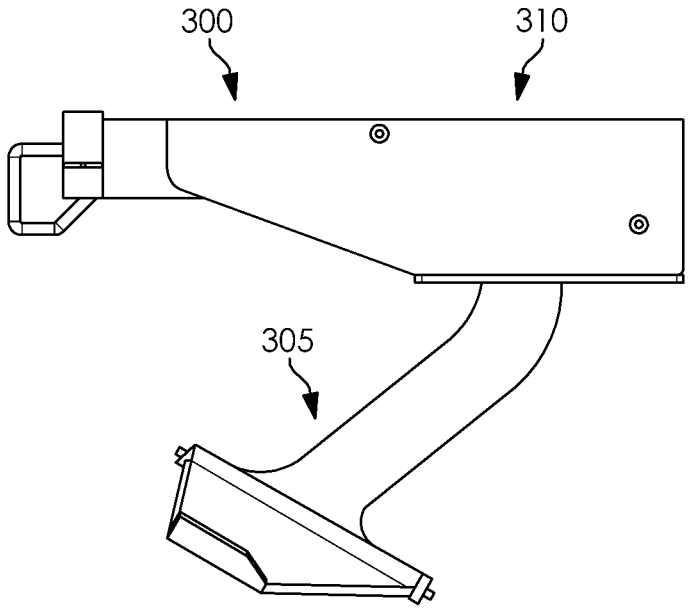
FIG. 4 is a side view of an exemplary apparatus, in accordance with at least some exemplary embodiments of the present disclosure.

FIGS. 4-8 illustrate assembly 300, another exemplary embodiment of the exemplary apparatus and method. As illustrated in FIG. 4, assembly 300 may include a foil assembly 305 that may be removably attachable to receiver assembly 310.

Figure 5:
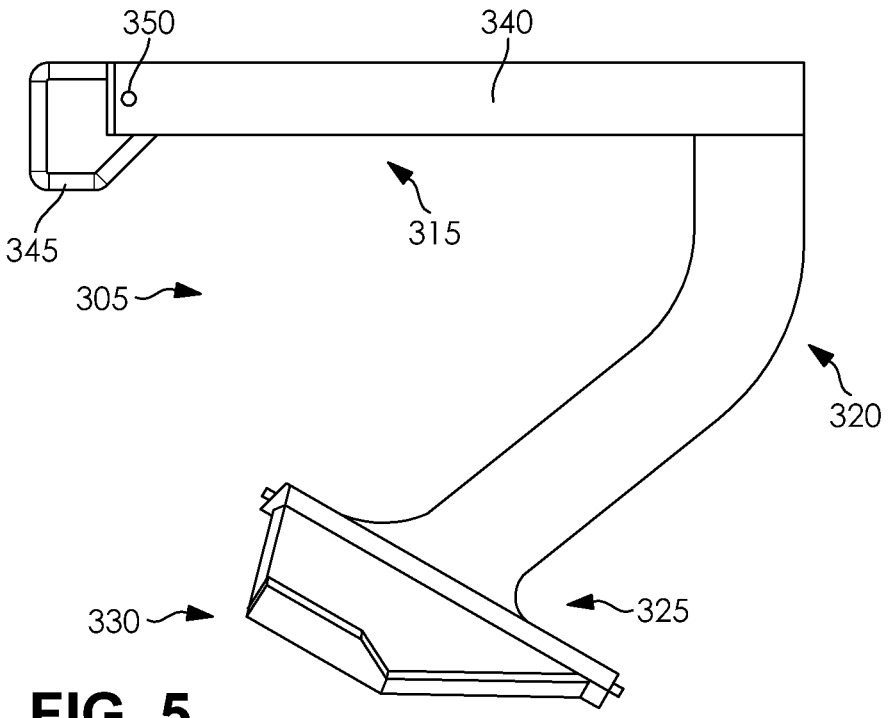
FIG. 5 is a side view of an exemplary apparatus, in accordance with at least some exemplary embodiments of the present disclosure.
Figure 6:
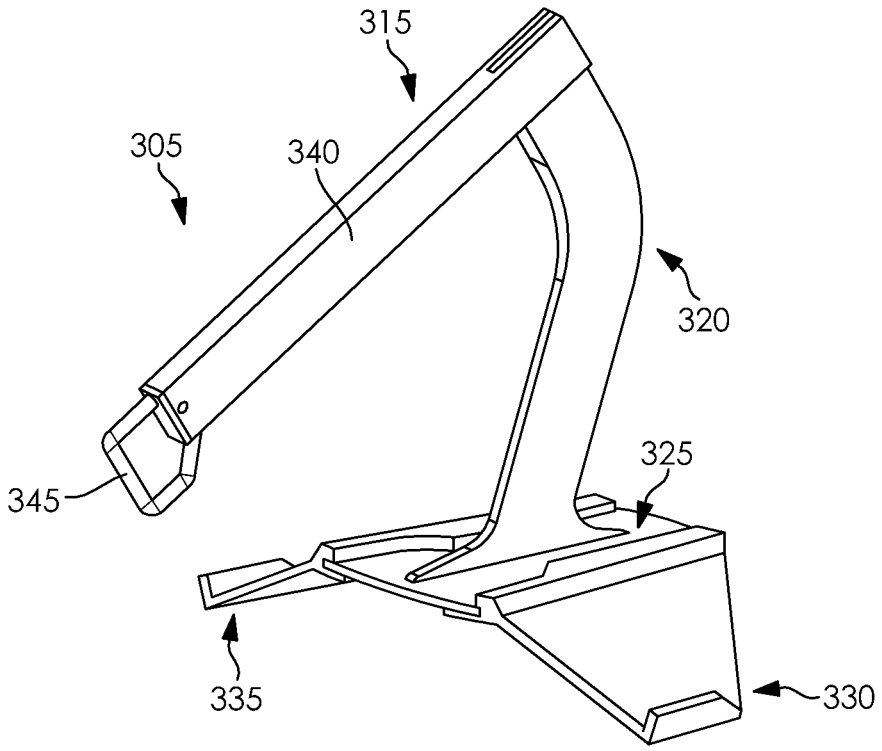
FIG. 6 is a perspective illustration of an exemplary apparatus, in accordance with at least some exemplary embodiments of the present disclosure.

As illustrated in FIGS. 5 and 6, foil assembly 305 may include an assembly 315, a member 320 that may be generally similar to member 220, a member 325 that may be generally similar to member 225, a member 330 that may be generally similar to member 230, and a member 335 that may be generally similar to member 235.

Assembly 315 may include a member 340, a handle 345, and an aperture 350. Member 340 may be an elongated structural member that may be attached to member 320. Handle 345 may be attached to an end portion of member 340 and may be used by a user to insert and remove foil assembly 305 from receiver assembly 310. Handle 345 may for example extend from a rear of assembly 300 and watercraft 100. Aperture 350 may receive a portion of receiver assembly 310 as disclosed below to secure foil assembly 305 to receiver assembly 310. Handle 345 may also include a handle lanyard that may be attached to receiver assembly 310 and/or watercraft 100 to maintain an attachment of foil assembly 305 to watercraft 100 (e.g., in case foil assembly 305 is inadvertently removed).

Members 330 and 335 (and/or members 230 and 235) may form, for example, a foil such as, e.g., a reverse hydrofoil (e.g., an inverse foil). Members 330 and 335 (and/or members 230 and 235) may be any suitable shape for a foil such as, for example, an inverted wing foil, a slightly U-shaped foil, an inverted dagger foil, and/or any other suitable foil shape or type.

Figure 7:
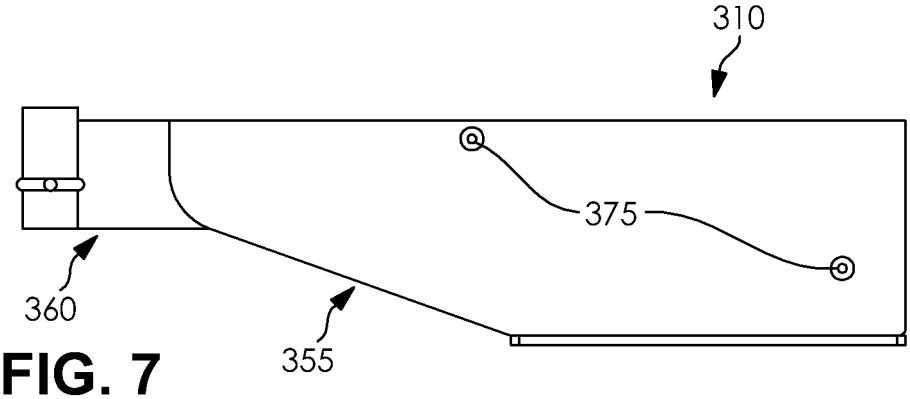
FIG. 7 is a side view of an exemplary apparatus, in accordance with at least some exemplary embodiments of the present disclosure.
Figure 8:
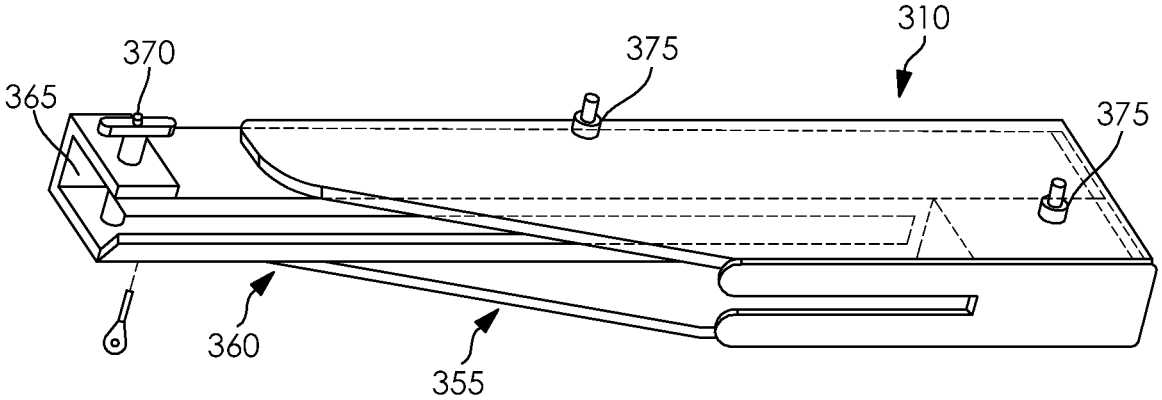
FIG. 8 is a perspective illustration of an exemplary apparatus, in accordance with at least some exemplary embodiments of the present disclosure.

As illustrated in FIGS. 7 and 8, receiver assembly 310 may have an assembly 355 that may be attached to an assembly 360. Receiver assembly 310 may be for example a structural strut member (e.g., an aluminum strut or a strut of any other desired material for example as disclosed above). A cavity 365 may be formed in assembly 360, and may extend longitudinally along a length of both assembly 355 and assembly 360 (e.g., wall portions of assemblies 355 and 360 may form cavity 365). Cavity 365 may be configured to receive member 340 of foil assembly 305. For example, cavity 365 may serve as a receiver track to receive member 340. For example, a user may slide member 340 into cavity 365, thereby attaching foil assembly 305 to receiver assembly 310. For example, cavity 365 may be configured to initially allow for a relatively loose fit of member 340 when it is first slid into cavity 365 (e.g., for the first few inches of being slid into cavity 365), followed by a relatively tighter fit (e.g., as member 340 is slid into the remainder of a length of cavity 365). For example, the relatively tighter fit may be provided by a guide block formed by wall portions of assemblies 355 and/or 360 that fits tightly around member 340 as it slides along cavity 365. Assembly 360 may include an aperture that may be aligned with aperture 350 of member 340 when member 340 is received in cavity 365 and may receive a fastener 370 (e.g., fastener 370 may be inserted through aperture 350 and the aperture of assembly 360 to fasten member 340 of foil assembly 305 to assembly 360 of receiver assembly 310). Fastener 370 may be any suitable fastener such as, for example, a bolt. Also for example, fastener 370 may be a pin that includes a lanyard that attaches fastener 370 to assembly 360 (e.g., so that fastener 370 is not separated from assembly 300). Also for example, fastener 370 may be any suitable type of locking bolt or pin such as, for example, a push pin (e.g., a soft touch push pin).

Figure 9:
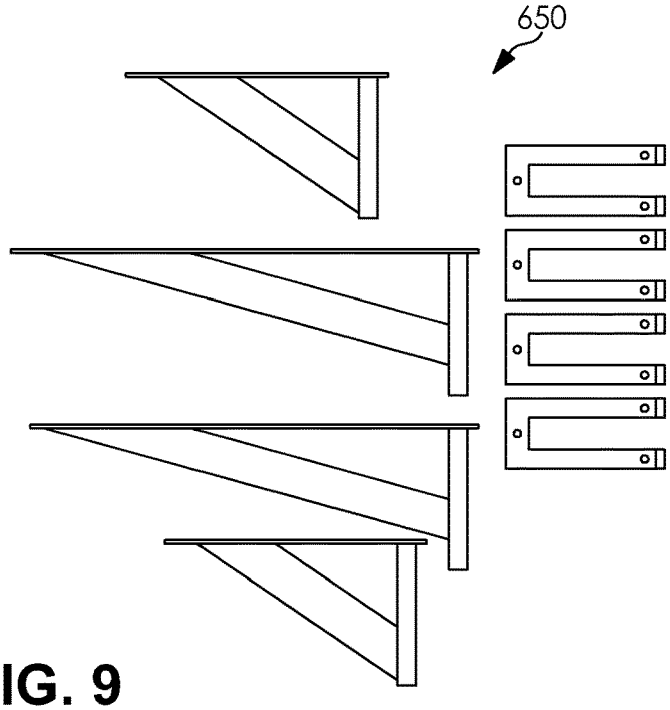
FIG. 9 is a plan view of an exemplary apparatus, in accordance with at least some exemplary embodiments of the present disclosure.
Figure 10:
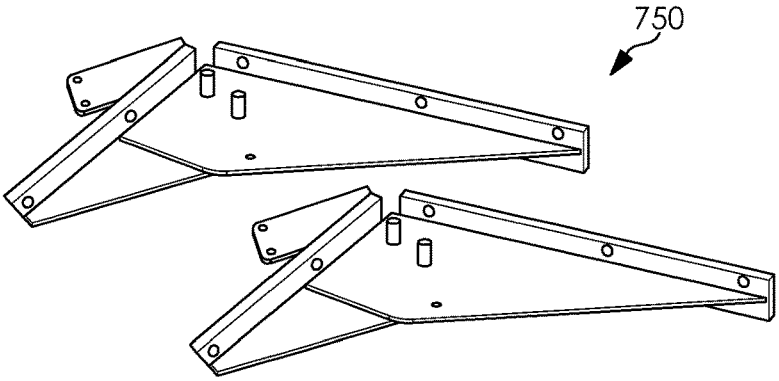
FIG. 10 is a plan view of an exemplary apparatus, in accordance with at least some exemplary embodiments of the present disclosure.
Figure 11:
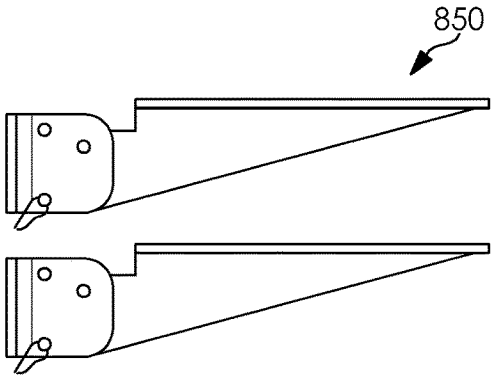
FIG. 11 is a plan view of an exemplary apparatus, in accordance with at least some exemplary embodiments of the present disclosure.

Receiver assembly 310 (e.g., and receiver assembly 210) may be attached to any suitable portion of watercraft by any suitable technique. For example, receiver assembly 310 may be attached to portions of watercraft 100 via one or more fasteners 375. Fasteners 375 may be any suitable type of fasteners such as, for example, bolts, rivets, screws, and/or any other suitable type of fastening device. For example as disclosed below, receiver assembly 310 may be attached to an existing bracket of watercraft 100 via fasteners 375. For example, receiver assembly 310 may be attached to an existing bracket supporting a swim board or other suitable component of watercraft 100 via fasteners 375. For example, receiver assembly 310 may be attached via fasteners 375 to an exemplary assembly 650 (e.g., as illustrated in FIG. 9), an exemplary assembly 750 (e.g., as illustrated in FIG. 10), and/or an exemplary assembly 850 (e.g., as illustrated in FIG. 11). Also for example, receiver assembly 310 may serve as a bracket to support a portion of watercraft 100 such as, for example, a swim board. Further for example, receiver assembly 210 and/or receiver assembly 310 may be attached to any desired portion of watercraft 100 by any suitable technique such as, e.g., bolting, riveting, adhesive, welding, and/or any other suitable fastening technique.

Assembly 200 and/or assembly 300 may include any desired materials (e.g., as disclosed for example above) and may include any desired finish and/or surface treatment. For example, assemblies 200 and/or 300 may have a polished surface, may be anodized, may have a chrome finish, and/or may be provided in any desired color such as black and/or any metallic or other color.

Figure 12:
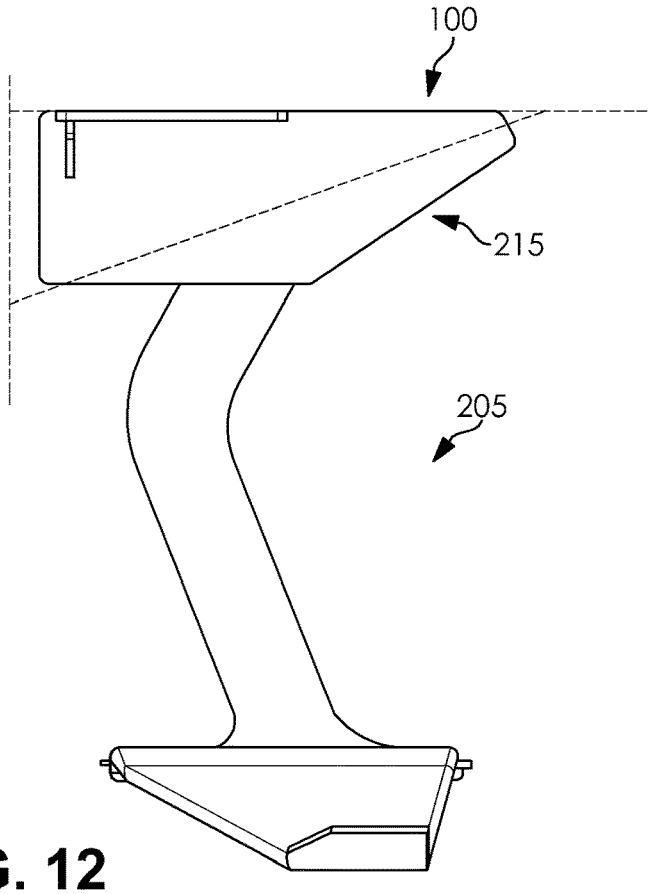
FIG. 12 is a schematic illustration of an exemplary apparatus, in accordance with at least some exemplary embodiments of the present disclosure.

Assembly 200 and/or assembly 300 may be attached to watercraft 100 by any desired technique. For example, assembly 200 and/or assembly 300 may be disposed away from a rudder and/or propeller of watercraft 100. For example, assembly 200 and/or 300 may be disposed on watercraft 100 in order to provide a clean water path and/or to substantially avoid cavitation. For example, FIG. 12 schematically illustrates an attachment of foil assembly 205 to a portion of watercraft 100 via receiver assembly 210 (not shown in schematic illustration of FIG. 12 for clarity) and/or directly to a portion of watercraft 100 (e.g., to a bracket supporting a swim platform of watercraft 100 or directly to a swim platform or other portion of watercraft 100).

Figure 13:
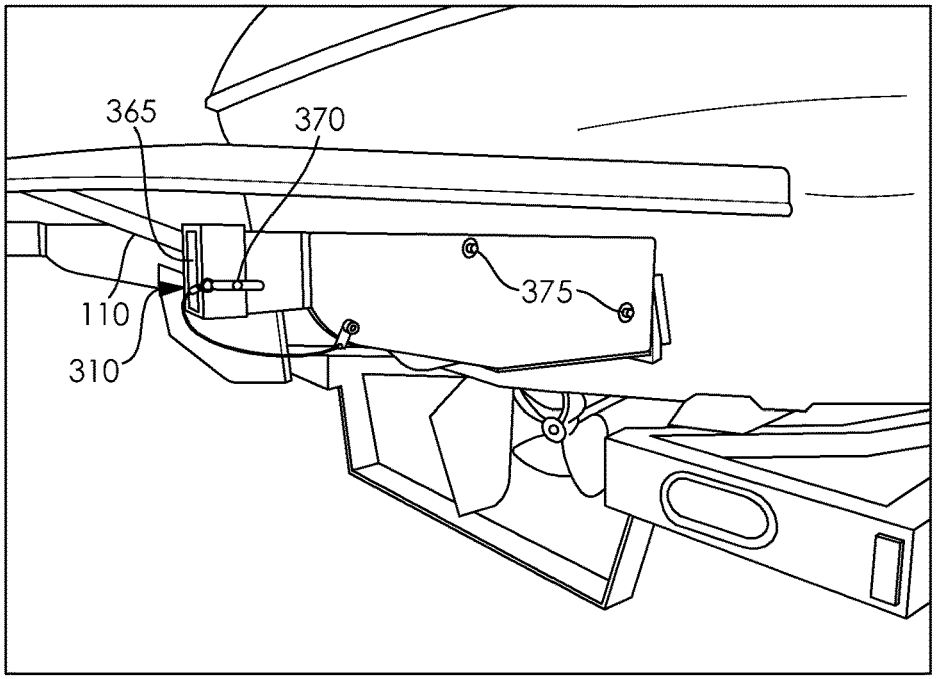
FIG. 13 is a perspective illustration of an exemplary apparatus, in accordance with at least some exemplary embodiments of the present disclosure.
Figure 14:
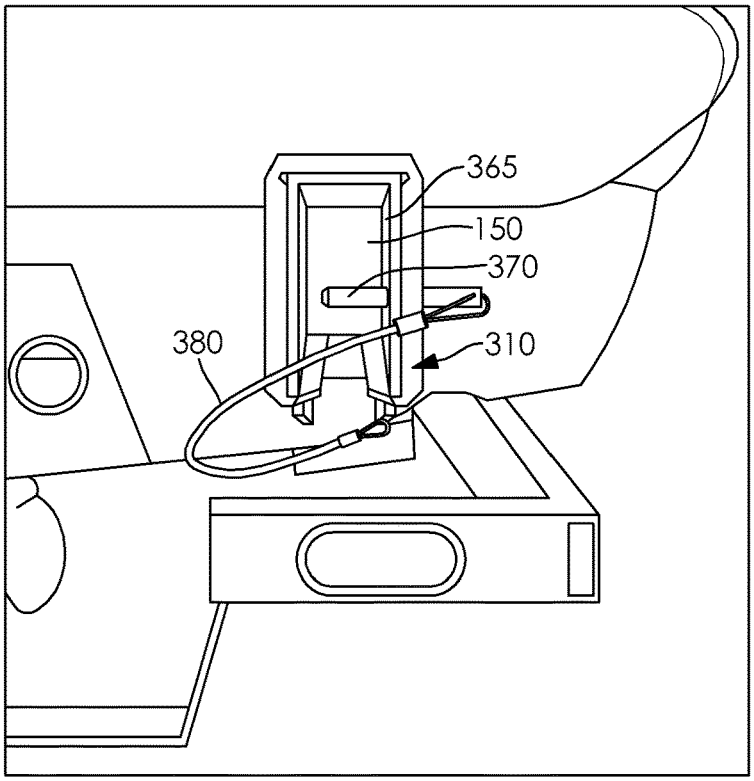
FIG. 14 is a perspective illustration of an exemplary apparatus, in accordance with at least some exemplary embodiments of the present disclosure.

As illustrated in FIGS. 13 and 14, receiver assembly 210 and/or receiver assembly 310 may for example be attached to an assembly 150 (e.g., and/or assemblies 650, 750, and/or 850) of watercraft 100. For example, assembly 150 may be a support bracket of a member 110 of watercraft 100. For example, member 110 may be a swim platform supported by assembly 150 that may be a swim platform bracket. As disclosed for example above, receiver assembly 210 and/or receiver assembly 310 may be attached to assembly 150 by any suitable technique. For example as illustrated in FIGS. 13 and 14, receiver assemblies 210 and/or 310 may be placed over assembly 150, e.g., so that assembly 150 is disposed in a cavity of receiver assemblies 210 and/or 310 (e.g., disposed in cavity 365 and/or another cavity of receiver assemblies 210 and/or 310). For example, when receiver assemblies 210 and/or 310 are disposed on assembly 150, fasteners 375 may extend through apertures of assembly 150 to fasten receiver assemblies 210 and/or 310 to assembly 150. FIG. 14 also illustrates for example that a lanyard 380 may attach fastener 370 to assembly 300 and/or watercraft 100 (e.g., so that fastener 370 is not separated from assemblies 200 and/or 300 and/or watercraft 100, and/or for example falls into the water and is lost). For example, fastener 370 attached to lanyard 380 may be attached to a hook or other fastening device that may be fastened to watercraft 100 and/or assemblies 200 and/or 300.

Figure 15:
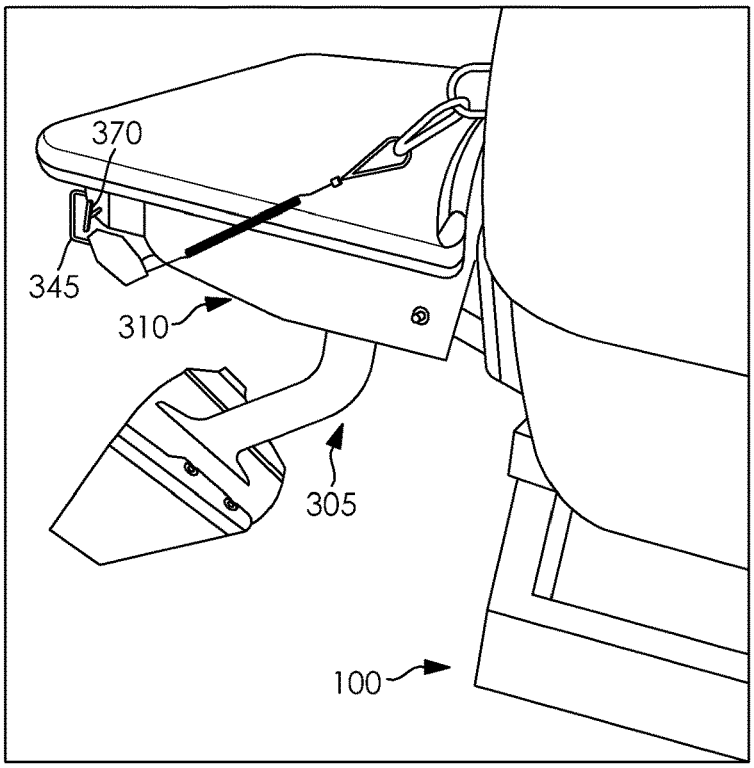
FIG. 15 is a perspective illustration of an exemplary apparatus, in accordance with at least some exemplary embodiments of the present disclosure.
Figure 16:
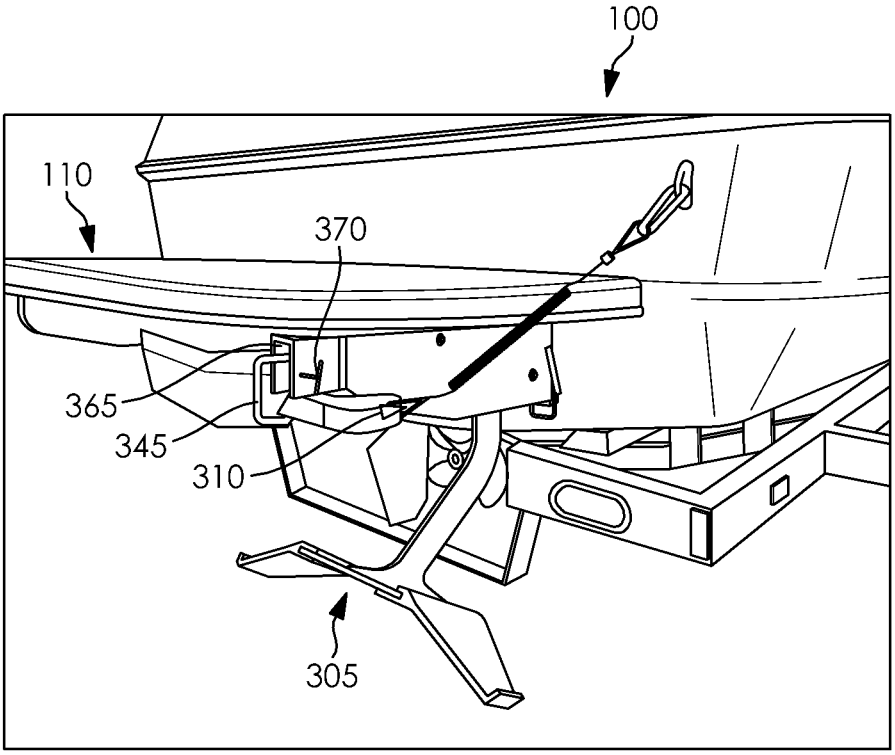
FIG. 16 is a perspective illustration of an exemplary apparatus, in accordance with at least some exemplary embodiments of the present disclosure.

As illustrated in FIGS. 15 and 16, foil assembly 305 (e.g., and/or foil assembly 205) may be removably attached to (e.g., or received by) receiver assembly 310 (e.g., and/or receiver assembly 210). For example as illustrated in FIGS. 15 and 16, foil assembly 305 (e.g., and/or foil assembly 205) may be received by receiver assembly 310 (e.g., and/or receiver assembly 210) so that handle 345 protrudes from cavity 365 and fastener 370 fastens foil assembly 305 (e.g., and/or foil assembly 205) to receiver assembly 310 (e.g., and/or receiver assembly 210).

Figure 17:
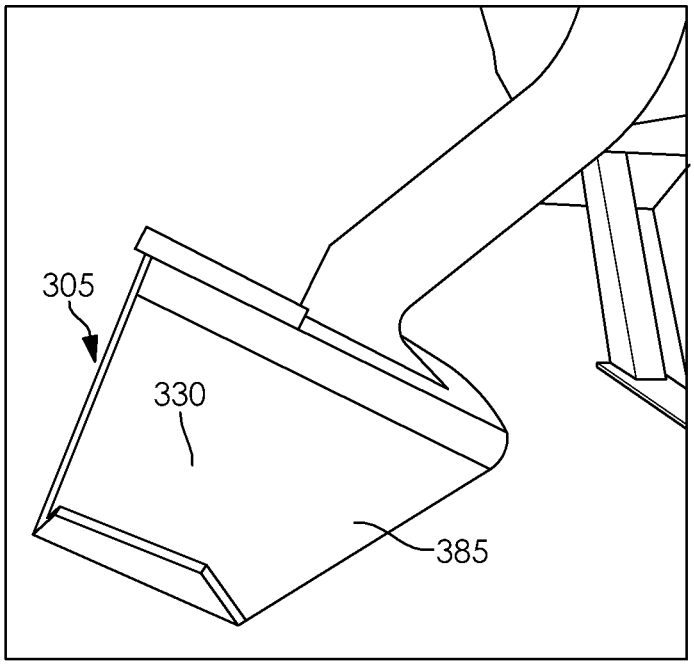
FIG. 17 is a perspective illustration of an exemplary apparatus, in accordance with at least some exemplary embodiments of the present disclosure.
Figure 18:
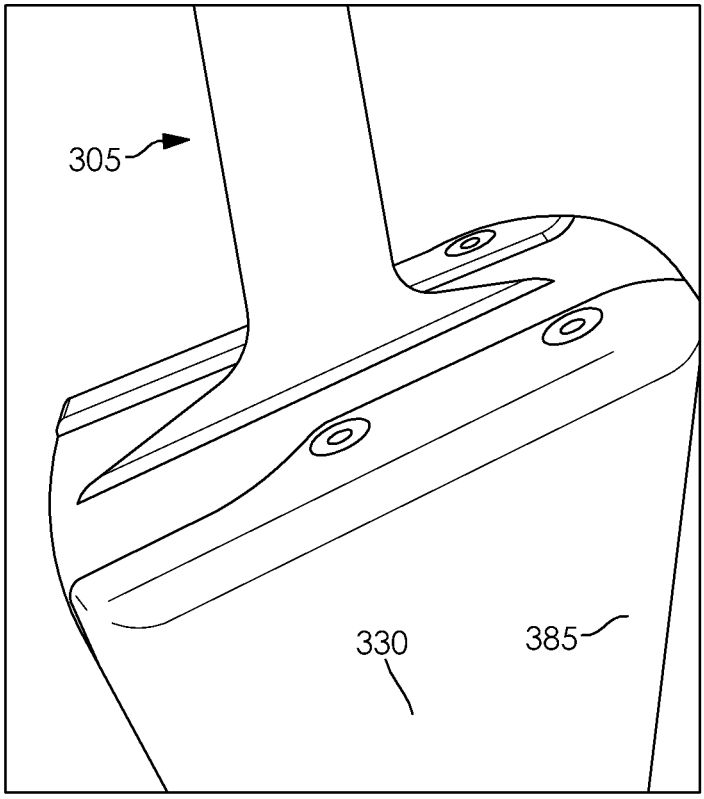
FIG. 18 is a perspective illustration of an exemplary apparatus, in accordance with at least some exemplary embodiments of the present disclosure.

As illustrated in FIGS. 17 and 18, foil assemblies 205 and/or 305 may be configured to be disposed at any desired angle (e.g., any desired angle of attack). For example as illustrated in FIG. 17, when foil assembly 305 (e.g., and/or foil assembly 205) is received by receiver assembly 310 (e.g., and/or receiver assembly 210), members 330 and 335 (e.g., and/or members 230 and/or 235) may be angled so that a front portion 385 is angled down (e.g., angled so that front portion 385 is pointed down). For example, the configuration illustrated in FIG. 17 may be a down force mode that causes a down force to be applied to assembly 300 (and/or assembly 200) and watercraft 100 as disclosed for example above. Foil assembly 305 (e.g., and/or foil assembly 205) may be angled down (e.g., angled forward) at any desired angle such as, for example, up to about 5 degrees from a horizontal plane, up to about 10 degrees from a horizontal plane, between about 5 degrees and about 15 degrees from a horizontal plane, between about 10 degrees and about 20 degrees from a horizontal plane, between about 15 degrees and about 25 degrees from a horizontal plane, between about 20 degrees and about 30 degrees from a horizontal plane, between about 25 degrees and about 35 degrees from a horizontal plane, between about 30 degrees and about 40 degrees from a horizontal plane, between about 35 degrees and about 45 degrees from a horizontal plane, up to about 15 degrees from a horizontal plane, up to about 30 degrees from a horizontal plane, up to about 45 degrees from a horizontal plane, and/or any desired angle up to about 90 degrees from (e.g., substantially perpendicular to) a horizontal plane. For example, members 330 and 335 (e.g., and/or members 230 and/or 235) may be angled down (e.g., angled forward) at about 25 degrees (e.g., have forward rotation of about 25 degrees, or any other desired angle). For example, foil assembly 305 (e.g., and/or foil assembly 205) may be configured to be at relatively high angles of attacks (e.g., between about 15 or 20 degrees and about 40 or 45 degrees).

Also for example as illustrated in FIG. 18, when foil assembly 305 (e.g., and/or foil assembly 205) is received by receiver assembly 310 (e.g., and/or receiver assembly 210), members 330 and 335 (e.g., and/or members 230 and/or 235) may be angled so that front portion 385 is angled up (e.g., angled so that front portion 385 is pointed up). For example, the configuration illustrated in FIG. 18 may be a lift mode that creates a lift force on a non surf side of watercraft 100 (e.g., may be used in a twin foil configuration as disclosed for example below). For example, the exemplary configuration illustrated in FIG. 18 may change underboat flow to create improved wake characteristics. Foil assembly 305 (e.g., and/or foil assembly 205) may be angled up at any desired angle such as, for example, up to about 5 degrees from a horizontal plane, up to about 10 degrees from a horizontal plane, between about 5 degrees and about 15 degrees from a horizontal plane, between about 10 degrees and about 20 degrees from a horizontal plane, between about 15 degrees and about 25 degrees from a horizontal plane, between about 20 degrees and about 30 degrees from a horizontal plane, between about 25 degrees and about 35 degrees from a horizontal plane, between about 30 degrees and about 40 degrees from a horizontal plane, between about 35 degrees and about 45 degrees from a horizontal plane, up to about 15 degrees from a horizontal plane, up to about 30 degrees from a horizontal plane, up to about 45 degrees from a horizontal plane, and/or any desired angle up to about 90 degrees from (e.g., substantially perpendicular to) a horizontal plane. For example, foil assembly 305 (e.g., and/or foil assembly 205) may be configured to be at relatively high angles (e.g., between about 15 or 20 degrees and about 40 or 45 degrees).

For example, foil assembly 305 (e.g., and/or foil assembly 205) may be manufactured to be preconfigured in any of the exemplary configurations disclosed above. Also for example, foil assembly 305 (e.g., and/or foil assembly 205) and/or receiver assembly 310 (e.g., and/or receiver assembly 210) may be adjustable to vary between any desired configuration (e.g., any of the exemplary configurations disclosed above). For example, any suitable attachment of foil assembly 305 (e.g., and/or foil assembly 205) and/or receiver assembly 310 (e.g., and/or receiver assembly 210) may be adjustable (e.g., rotatable) so that an angle between attached members may be changed to adjust an angle of foil assembly 305 (e.g., and/or foil assembly 205). For example, an angle between assembly 215 (e.g., or assembly 315) and member 220 (e.g., or member 320), and between member 220 (e.g., or member 320) and member 225 (e.g., or member 325) may be adjusted so that foil assembly 305 (e.g., and/or foil assembly 205) may be angled as desired (e.g., adjusted to be in any of the exemplary configurations disclosed above).

Figure 19:
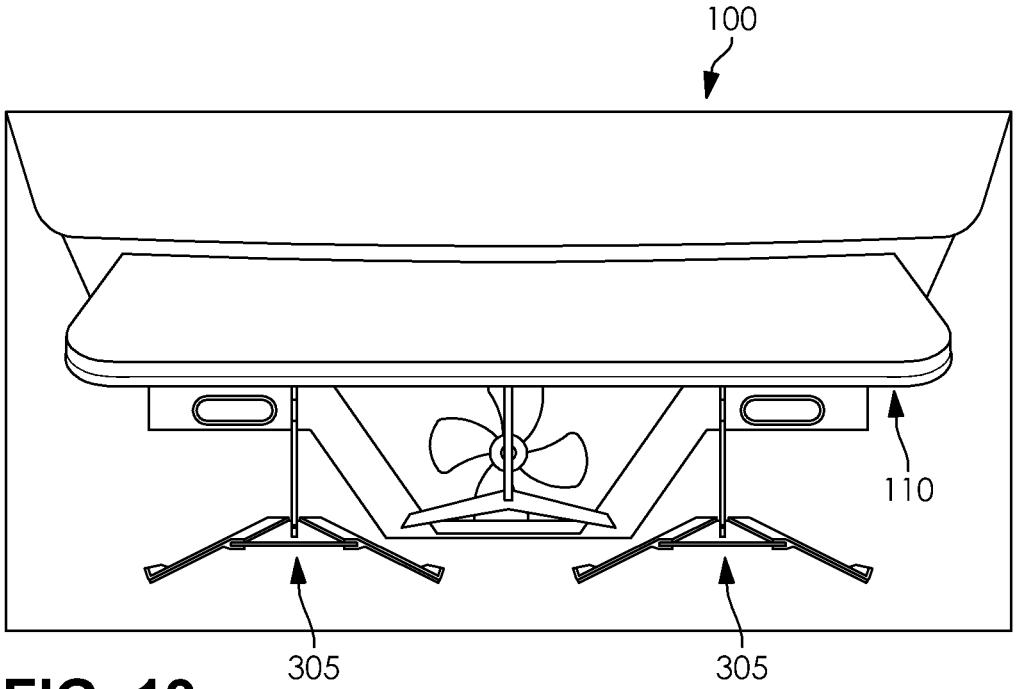
FIG. 19 is a perspective illustration of an exemplary apparatus, in accordance with at least some exemplary embodiments of the present disclosure.
Figure 20:
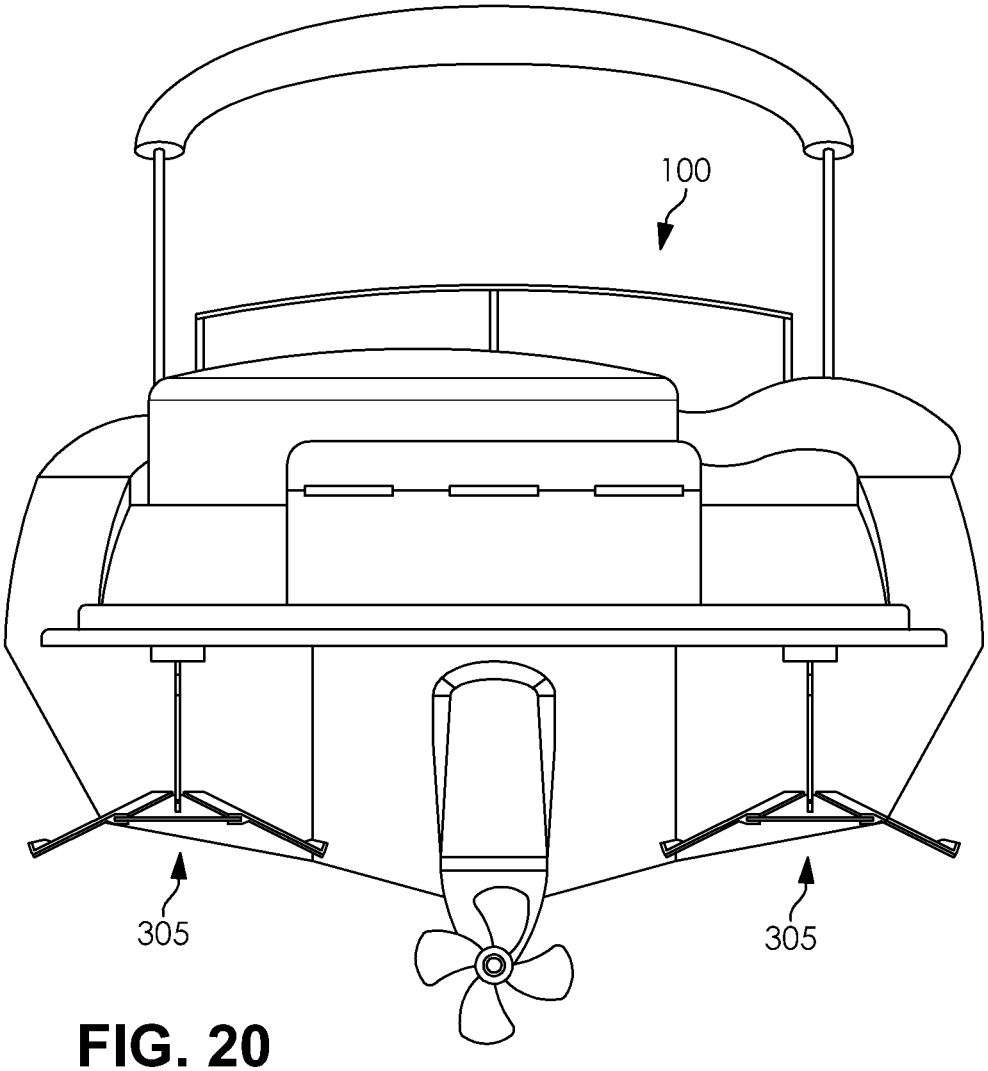
FIG. 20 is a perspective illustration of an exemplary apparatus, in accordance with at least some exemplary embodiments of the present disclosure.

Any suitable configuration of one, two, three, four, or more assemblies 200 and/or 300 may be provided on watercraft 100. For example as illustrated in FIG. 19, two assemblies 300 including foil assemblies 305 (e.g., and/or two assemblies 200 including foil assemblies 205) may be disposed symmetrically about a longitudinal centerline of watercraft 100 (e.g., in a twin inverse foil configuration for a jet drive watercraft). Also for example as illustrated in FIG. 20, two assemblies 300 including foil assemblies 305 (e.g., and/or two assemblies 200 including foil assemblies 205) may be disposed symmetrically about a longitudinal centerline of stern drive watercraft 100 (e.g., in a twin inverse foil configuration for a stern drive watercraft). For example, one or more foil assemblies 305 (e.g., and/or foil assemblies 205) may be disposed in a down force mode (e.g., as illustrated in FIG. 17) configuration, and one or more foil assemblies 305 (e.g., and/or foil assemblies 205) may be disposed in a lift mode (e.g., as illustrated in FIG. 18) configuration. Also for example, some of a plurality of foil assemblies 305 (e.g., and/or foil assemblies 205) may be disposed in a down force mode (e.g., as illustrated in FIG. 17) configuration and some of a plurality of foil assemblies 305 (e.g., and/or foil assemblies 205) may be disposed in a lift mode (e.g., as illustrated in FIG. 18) configuration to form any desired mixed down force/lift configuration. For example, a foil assembly 305 (e.g., and/or foil assembly 205) may be disposed in a down force mode on one side of watercraft 100 and a foil assembly 305 (e.g., and/or foil assembly 205) may be disposed in a lift mode on another side of watercraft 100 to provide favorable wake characteristics for wake surfing and/or wakeboarding. Any of the plurality of fixed or adjustable foil assemblies 305 (e.g., and/or foil assemblies 205) may be placed in any desired configuration (e.g., location, position, and/or angle of attack) disclosed for example above to achieve any desired wake enhancement configuration. Any suitable number of assemblies 200 and/or 300 may be disposed on a given watercraft 100.

A same foil assembly 305 (e.g., and/or foil assembly 205) may be removably attachable between different receiver assemblies 310 (e.g., and/or receiver assemblies 210). For example, a user may remove foil assembly 305 (e.g., and/or foil assembly 205) from a receiver assembly 310 (e.g., and/or receiver assembly 210) on one side of watercraft 100 and attach the same foil assembly 305 (e.g., and/or foil assembly 205) to a receiver assembly 310 (e.g., and/or receiver assembly 210) on another side of watercraft 100. A user may similarly quickly place and/or interchange any desired combination of foil assemblies 305 (e.g., and/or foil assemblies 205) between any desired combination of receiver assemblies 310 (e.g., and/or receiver assemblies 210).

For example, the exemplary apparatus may include a receiver assembly (e.g., receiver assembly 210 or receiver assembly 310) that is watercraft-attachable (e.g., attachable to watercraft 100) and an attachment assembly (e.g., assembly 215 or assembly 315) that is removably attachable to the receiver assembly. The exemplary apparatus may also include a connecting assembly (e.g., member 220 or member 320) having a first end portion attached to the attachment assembly. The connecting assembly may extend downward from the attachment assembly. The exemplary apparatus may also include a lower assembly (e.g., members 225, 230, and/or 235 or members 325, 330, and/or 335) attached to a second end portion of the connecting assembly. The lower assembly may have a first portion (e.g., portion 232 or portion 237) extending from the connecting assembly and a second portion (e.g., portion 255 or portion 260) extending from the first portion. The first portion may be bent downward and the second portion may be bent upward. The lower assembly may be an inverted wing foil or an inverted dagger foil. The attachment assembly may include a handle (e.g., handle 345), which may protrude from the receiver assembly when the attachment assembly is removably attached to the receiver assembly. The receiver assembly may be an aluminum strut. A lanyard may be attached to the attachment assembly. At least one of a first attachment between the attachment assembly and the first end portion of the connecting assembly and a second attachment between the second end portion of the connecting assembly and the lower assembly may be adjustable (e.g., may be a rotatable attachment).

Figure 21A:
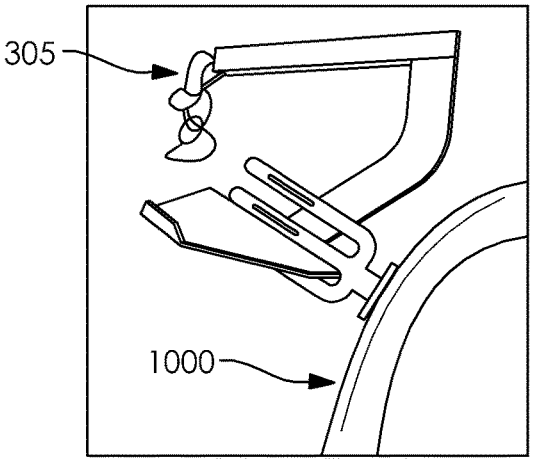
FIG. 21A is a perspective illustration of an exemplary apparatus, in accordance with at least some exemplary embodiments of the present disclosure.
Figure 21B:
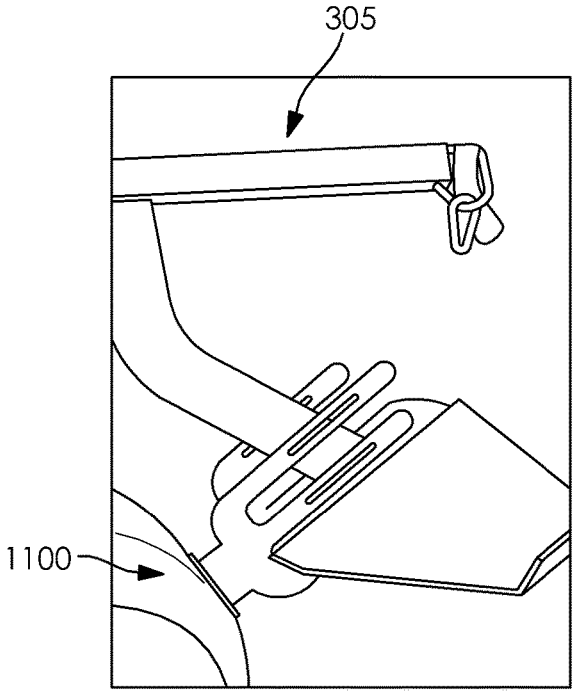
FIG. 21B is a perspective illustration of an exemplary apparatus, in accordance with at least some exemplary embodiments of the present disclosure.

When not attached to receiver assembly 310 (e.g., and/or receiver assembly 210), foil assembly 305 (e.g., and/or foil assembly 205) may be for example stowed at any suitable portion of watercraft 100. For example as illustrated in FIGS. 21A and 21B, foil assembly 305 (e.g., and/or foil assembly 205) may be stowed in any suitable rack system of watercraft 100 such as, e.g., system 1000 and/or system 1100.

Figure 22:
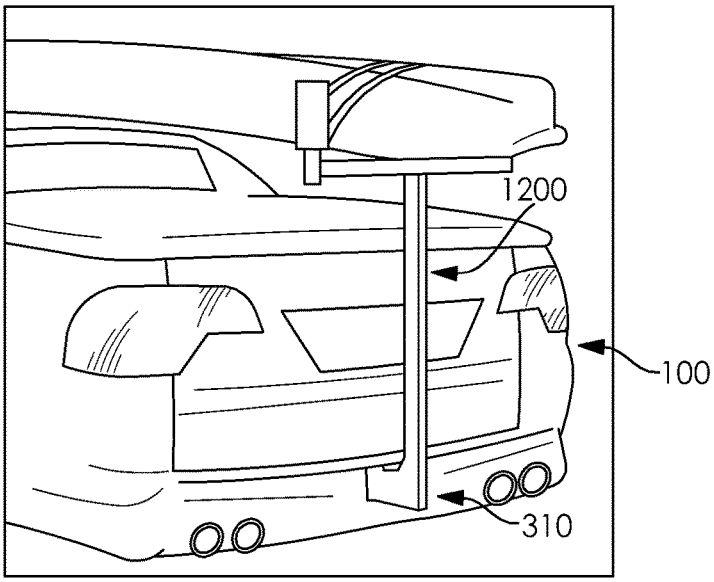
FIG. 22 is a perspective illustration of an exemplary apparatus, in accordance with at least some exemplary embodiments of the present disclosure.

Also for example, when not receiving foil assembly 305 (e.g., and/or foil assembly 205), receiver assembly 310 (e.g., and/or receiver assembly 210) may be used to receive any desired accessory for use on watercraft 100. For example, receiver assembly 310 (e.g., and/or receiver assembly 210) may be used to attach any desired accessory such as, e.g., furniture such as a table and/or chair, a barbecue or grill assembly, tower side mount assembly, a surfboard rack, a snack and beverage holder, a cooler, a kayak rack, and/or any other desired accessory. For example, FIG. 22 illustrates a system 1200 such as a kayak support rack that may be mounted to receiver assembly 310 (e.g., and/or receiver assembly 210) of watercraft 100 that may quickly be converted into a wake boat by removing system 1200 and attaching foil assembly 305 (e.g., and/or foil assembly 205) to receiver assembly 310.

Further for example, in at least some exemplary embodiments, the exemplary disclosed assembly (e.g., assembly 200 and/or assembly 300) may be a fixed manual dual foil system that is quickly removable. For example, in at least some exemplary embodiments, the exemplary assembly may be manually operated and may not include powered components and/or electronic control mechanisms. For example, in at least some exemplary embodiments, the exemplary foil assembly may be manually configured and/or positioned (e.g., an angle of attack of the exemplary foil assembly may be manually positioned) and may be manually slid in and out of the exemplary receiver assembly. For example, in at least some exemplary embodiments, the exemplary disclosed assembly may be mounted to a swim platform of watercraft 100, on both sides of a centerline of watercraft 100 in a dual foil system configuration. For example, in at least some exemplary embodiments, the exemplary disclosed foil assemblies may be removably mountable as disclosed for example herein and not permanently mounted. Also for example, the exemplary receiver assembly (e.g., receiver assembly 210 and/or receiver assembly 310) may quickly receive accessories after the exemplary foil assembly (e.g., foil assembly 205 and/or foil assembly 305) is quickly removed (e.g., quickly manually removed) by the user.

The exemplary disclosed apparatus and method may be used in any suitable application for enhancing wave characteristics. For example, the exemplary disclosed apparatus and method may be used on any suitable watercraft for shaping of a wake. For example, the exemplary disclosed apparatus and method may be used for wake shaping for any desired activity such as, e.g., wake surfing and/or wakeboarding. For example, the exemplary disclosed apparatus and method may be used in any desired application that increases a height and/or optimizes shape characteristics of a watercraft wake.

An exemplary operation of the exemplary disclosed apparatus and method will now be described. Assemblies 200 and/or 300 may be provided at any suitable location of watercraft 100 as disclosed for example above. For example, receiver assemblies 210 and/or 310 may be attached to assembly 150 (e.g., a swim platform bracket or any other suitable structural assembly), e.g., that may support a member 110 (e.g., a swim platform or any other suitable member of watercraft 100). For example, receiver assemblies 210 and/or 310 may be provided on both sides of watercraft 100 (e.g., at a stern of watercraft 100 at both a starboard and port side).

One or more foil assemblies 205 and/or 305 may be stowed on watercraft 100 (e.g., at system 1000 and/or system 1100 as disclosed above). Also for example, an exemplary accessory may be initially inserted into receiver assemblies 210 and/or 310 such as, e.g., system 1200 for storing kayaks or any other desired accessory. When a user desires to convert watercraft 100 into a wake boat, the user may remove the accessory (e.g., system 1200) from receiver assemblies 210 and/or 310 and stow the accessory as desired on watercraft 100. The user may then remove one or more foil assemblies 205 and/or 305 from a stowed location (e.g., from system 1000 or 1100) and insert one or more foil assemblies 205 and/or 305 into one or more receiver assemblies 210 and/or 310. For example, the user may grasp the exemplary foil assembly by the handle (e.g., handle 345). The user may adjust any adjustable components (e.g., as disclosed above) of foil assemblies 205 and/or 305 and/or receiver assemblies 210 and/or 310 to provide any desired angle of attack as disclosed for example above.

For example, the user may insert member 340 into cavity 365 of receiver assembly 310. Member 340 may initially loosely fit into cavity 365 for the first part of insertion, and then be more tightly received within cavity 365 as member 340 is substantially fully inserted into cavity 365. Once member 340 is substantially entirely inserted into receiver assembly 310, the user may fasten foil assembly 305 to receiver assembly 310 via fastener 370 as disclosed above. Also for example, the user may fasten a lanyard attached to the handle of the exemplary foil assembly to a hook disposed on watercraft 100 or the exemplary receiver assembly to secure the exemplary foil assembly to watercraft 100 during use. Any desired arrangement (e.g., as disclosed above) of foil assemblies 205 and/or 305 may be configured by the user.

The user may then operate watercraft 100 as a wake boat to provide down force to watercraft 100 and/or lift force or any desired wake characteristics for water activities such as wake surfing and/or wakeboarding based on the selected arrangement and angle of attack of foil assemblies 205 and/or 305 configured by the user.

During an operation of watercraft 100 as a wake boat, the user may quickly reconfigure the arrangements of foil assemblies 205 and/or 305 to change wave characteristics created by assemblies 200 and/or 300 as desired. For example, one or more users may slow or stop watercraft 100. One or more users may then release exemplary fasteners (e.g., fastener 370) attaching any foil assemblies 205 and/or 305 to be reconfigured from receiver assemblies 210 and/or 310. One or more foil assemblies 205 and/or 305 may then be removed from their respective receiver assemblies 210 and/or 310 and placed in other desired receiver assemblies 210 and/or 310. Also for example, an angle of attack of one or more foil assemblies 205 and/or 305 may be adjusted while either retained by receiver assembly 210 and/or 310 or when removed from a given receiver assembly 210 and/or 310.

After any desired rearrangement has been configured by the one or more users and exemplary fasteners (e.g., fastener 370) and exemplary lanyards securing the exemplary foil assemblies have been fastened, the one or more users may resume operation of watercraft 100 as a wake boat to facilitate water activities (e.g., wake surfing, wakeboarding, and/or any other desired activity).

After one or more users finish utilizing watercraft 100 as a wake boat, foil assemblies 205 and/or 305 may be removed from receiver assemblies 210 and/or 310 and stowed. Watercraft 100 may then be operated in a normal mode (e.g., at relatively high speeds to optimize efficient water travel and/or any other desired use). Also for example, any desired accessory (e.g., system 1200 and/or any other desired accessory as disclosed above) may again be placed in receiver assemblies 210 and/or 310 if desired.

For example, the exemplary wake enhancement method may include attaching a receiver assembly (e.g., receiver assembly 210 or receiver assembly 310) to a watercraft (e.g., watercraft 100), removably attaching a reverse hydrofoil (e.g., foil assembly 205 or foil assembly 305) to the receiver assembly, and controlling wake characteristics of the watercraft based on positioning the reverse hydrofoil. The reverse hydrofoil may be in a position that is angled upward or downward relative to a horizontal plane when the reverse hydrofoil is attached to the receiver assembly. The reverse hydrofoil may apply a down force to the watercraft when the reverse hydrofoil is angled downward. The reverse hydrofoil may for example apply a down force of up to about 900 pounds to the watercraft. The reverse hydrofoil may be angled downward at about 25 degrees. The reverse hydrofoil may create a lift force when the reverse hydrofoil is angled upward.

Also for example, the exemplary wake enhancement method may include attaching a first receiver assembly (e.g., receiver assembly 210 or receiver assembly 310) and a second receiver assembly (e.g., receiver assembly 210 or receiver assembly 310) to a stern portion of a watercraft (e.g., watercraft 100), removably attaching a first reverse hydrofoil (e.g., foil assembly 205 or foil assembly 305) to the first receiver assembly, removably attaching a second reverse hydrofoil (e.g., foil assembly 205 or foil assembly 305) to the second receiver assembly, and controlling wake characteristics of the watercraft based on positioning the first and second reverse hydrofoils. For example, the first reverse hydrofoil may be in a first position that is angled upward or downward relative to a horizontal plane when the first reverse hydrofoil is attached to the first receiver assembly. Also for example, the second reverse hydrofoil may be in a second position that is angled upward or downward relative to the horizontal plane when the second reverse hydrofoil is attached to the second receiver assembly. Also for example, the first reverse hydrofoil may be angled downward relative to the horizontal plane when the first reverse hydrofoil is attached to the first receiver assembly, and the second reverse hydrofoil may be angled upward relative to the horizontal plane when the second reverse hydrofoil is attached to the second receiver assembly. Further for example, the first and second reverse hydrofoils may be angled downward relative to the horizontal plane when the first reverse hydrofoil is attached to the first receiver assembly and the second reverse hydrofoil is attached to the second receiver assembly. Additionally for example, the first and second reverse hydrofoils may be angled upward relative to the horizontal plane when the first reverse hydrofoil is attached to the first receiver assembly and the second reverse hydrofoil is attached to the second receiver assembly. Also for example, the first reverse hydrofoil may be angled downward at about 25 degrees relative to the horizontal plane when the first reverse hydrofoil is attached to the first receiver assembly, and the second reverse hydrofoil may be angled upward relative to the horizontal plane when the second reverse hydrofoil is attached to the second receiver assembly.

Several advantages may be associated with the exemplary disclosed apparatus and method. For example, the exemplary disclosed apparatus and method may be easily mounted to a watercraft with no substantial modification to a watercraft hull in order to quickly convert the watercraft into a wake boat. Also for example, the exemplary disclosed apparatus and method may provide an efficient technique for providing suitably shaped waves (e.g., wakes) and also down force to a watercraft for providing suitable waves for recreational use. Further for example, the exemplary disclosed apparatus and method may provide an efficient wake enhancement technique that does not negatively impact watercraft handling and control. Additionally for example, the exemplary disclosed apparatus and method may provide a wake enhancement technique that may be used with a wide variety of watercraft types and hull configurations. Further for example, the exemplary apparatus and method may create a wake having natural curl and push similar to an actual surf wave.

While multiple embodiments are disclosed, still other embodiments of the present disclosure will become apparent to those skilled in the art from this detailed description. There may be aspects of this disclosure that may be practiced without the implementation of some features as they are described. It should be understood that some details have not been described in detail in order to not unnecessarily obscure the focus of the disclosure. The disclosure is capable of myriad modifications in various obvious aspects, all without departing from the spirit and scope of the present disclosure. Accordingly, the drawings and descriptions are to be regarded as illustrative rather than restrictive in nature.

What is claimed is:

1. A wake enhancement apparatus, comprising:

a receiver assembly that is watercraft-attachable;

an attachment assembly that is removably attachable by a fastener to the receiver assembly, the attachment assembly including an elongated structural member;

a connecting assembly having a first end portion attached to the attachment assembly, the connecting assembly including a strut member that extends downward from the attachment assembly; and a lower assembly attached to a second end portion of the connecting assembly, the lower assembly including a plurality of foil plate members;

wherein each of the plurality of foil plate members has a first portion extending from the connecting assembly and a second portion extending from the first portion;

wherein the first portion is bent downward and the second portion is bent upward;

wherein the attachment assembly includes a handle; and wherein the handle protrudes from the receiver assembly when the attachment assembly is removably attached to the receiver assembly by the fastener.

2. The wake enhancement apparatus of claim 1, wherein the lower assembly is an inverted wing foil including the plurality of foil plate members.

3. The wake enhancement apparatus of claim 1, wherein the receiver assembly is an aluminum strut.

4. The wake enhancement apparatus of claim 1, wherein a lanyard is attached to the attachment assembly.

5. A wake enhancement method, comprising:

attaching a receiver assembly to a watercraft;

removably attaching a reverse hydrofoil to the receiver assembly;

controlling wake characteristics of the watercraft based on positioning the reverse hydrofoil; and removably attaching a watercraft accessory to the receiver assembly by using a fastener;

wherein the reverse hydrofoil is in a position that is angled upward or downward relative to a horizontal plane when the reverse hydrofoil is attached to the receiver assembly; and wherein the watercraft accessory is selected from the group consisting of a table, a chair, a barbecue assembly, a tower side mount assembly, a surfboard rack, a beverage holder, and a kayak rack.

6. The wake enhancement method of claim 5, wherein the reverse hydrofoil applies a down force to the watercraft when the reverse hydrofoil is angled downward.

7. The wake enhancement method of claim 6, wherein the reverse hydrofoil applies a down force of up to about 900 pounds to the watercraft.

8. The wake enhancement method of claim 5, wherein the reverse hydrofoil is angled downward at about 25 degrees.

9. The wake enhancement method of claim 5, wherein the reverse hydrofoil creates a lift force when the reverse hydrofoil is angled upward.

10. The wake enhancement method of claim 5, wherein attaching the receiver assembly to the watercraft includes attaching the receiver assembly to a swim platform bracket of the watercraft.

11. A wake enhancement apparatus, comprising:

a receiver assembly that is watercraft-attachable;

an attachment assembly that is removably attachable by a fastener to the receiver assembly, the attachment assembly including an elongated structural member;

a connecting assembly having a first end portion attached to the attachment assembly, the connecting assembly including a strut member that extends downward from the attachment assembly; and a lower assembly attached to a second end portion of the connecting assembly, the lower assembly including a plurality of foil plate members;

wherein each of the plurality of foil plate members has a first portion extending from the connecting assembly and a second portion extending from the first portion;

wherein the first portion is bent downward and the second portion is bent upward; and wherein a lanyard is attached to the attachment assembly.

12. The wake enhancement apparatus of claim 11, wherein the lower assembly is an inverted wing foil including the plurality of foil plate members.

13. The wake enhancement apparatus of claim 11, wherein the attachment assembly includes a handle.

14. The wake enhancement apparatus of claim 13, wherein the handle protrudes from the receiver assembly when the attachment assembly is removably attached to the receiver assembly by the fastener.

15. The wake enhancement apparatus of claim 11, wherein the receiver assembly is an aluminum strut.

* * * * *